United States Patent [19]

Jensen

[11] 4,172,026

[45] Oct. 23, 1979

[54] METHOD FOR LOWERING THE POUR POINT OF SHALE OIL, AND THE RESULTING SHALE OIL COMPOSITION

[75] Inventor: Harbo P. Jensen, San Rafael, Calif.

[73] Assignee: Chevron Research Company, San Francisco, Calif.

[21] Appl. No.: 891,568

[22] Filed: Mar. 29, 1978

[51] Int. Cl.[2] ..... C10G 9/00

[52] U.S. Cl. ..... 208/14; 208/46; 208/370

[58] Field of Search ..... 208/14, 106, 46, 370

[56] References Cited

U.S. PATENT DOCUMENTS

| | | | |
|---|---|---|---|
| 781,240 | 1/1905 | Starke | 208/106 |
| 3,284,336 | 11/1966 | Culbertson et al. | 208/11 R |
| 3,523,071 | 8/1970 | Knapp et al. | 208/14 |
| 3,532,618 | 10/1978 | Wunderlich et al. | 208/14 |

OTHER PUBLICATIONS

Sachanen: "The Chemical Constituents of Petroleum," 1945, pp. 302 to 306.

*Primary Examiner*—Herbert Levine
*Attorney, Agent, or Firm*—D. A. Newell; R. H. Davies; M. K. Bosworth

[57] ABSTRACT

The pour point of a high-pour-point shale oil is lowered by mixing it with a low-pour-point whole shale oil. Both the method and the resulting composition are claimed.

6 Claims, 1 Drawing Figure

METHOD FOR LOWERING THE POUR POINT OF SHALE OIL, AND THE RESULTING SHALE OIL COMPOSITION

FIELD OF THE INVENTION

This invention relates to a method for lowering the pour point of a shale oil. The invention also relates to a shale oil composition comprising a mixture of high- and low-pour-point shale oils.

BACKGROUND OF THE INVENTION

Shale oils produced by conventional retorting processes generally have pour points in the range from 65° to 85° F. (18° to 29° C.). Shale oil retorts, for economic reasons, are generally located near oil shale deposits and these are usually located in remote areas, such as Colorado. Since the temperature in these areas is frequently below freezing (32° F., 0° C.), high-pour-point shale oil cannot be handled at these low temperatures unless measures are taken to prevent the oil from being cooled below its pour point and setting up. Since it may be desirable to transport shale oil by pipeline or tank car from the retorting site to a location where it may be conveniently processed, it is especially important to be able to keep the shale oil from setting up while it is being transported. Various methods have been disclosed for lowering the pour point of shale oils and for making a shale oil blend having a lowered pour point, but the need remains for a simple, inexpensive method to make a low-pour-point shale oil blend.

U.S. Pat. No. 3,284,336 discloses that a heavy fraction separated from a crude shale oil can be thermally treated and blended with a light fraction to produce a low-pour-point oil. Although the heavy fraction, after thermal treatment, does not have a low pour point, it is claimed as a pour point depressant for petroleum oils or fractions.

U.S. Pat. No. 3,532,618 discloses a composition having a reduced pour point which comprises a shale oil having a pour point above 20° F. and the asphaltene portion of a hydrovisbroken shale oil. Hydrovisbreaking is a different process from thermal treating. Hydrovisbreaking lowers the pour point predominantly by cracking paraffins in the oil, whereas thermal treating lowers the pour point by forming a pour point depressant.

U.S. Pat. No. 3,523,071 discloses that the high-boiling fraction of visbroken shale oil is effective in reducing the pour point of hydrodenitrogenated shale oil, but that it is not effective in reducing the pour point of a raw shale oil.

U.S. Pat. No. 3,738,931 discloses that a low-pour-point product can be made by visbreaking shale oil, separating and hydrogenating the visbroken vapors and recombining them with the visbroken liquid.

The above references demonstrate that the pour point of a shale oil composition cannot be predicted from a knowledge of the pour points of the individual components. Surprisingly and in spite of this unpredictability, I have found a shale oil composition which has a low pour point, and which is suitable for being transported in cold weather without fear of it setting up.

SUMMARY OF THE INVENTION

In accordance with one embodiment of the present invention, there is provided an improved low-pour-point shale oil composition comprising in admixture, a first shale oil having a pour point above 20° F. (−7° C.) and a second, whole, shale oil having a pour point below 20° F. (−7° C.), said second shale oil being present in said composition in an amount sufficient to provide said composition with a pour point significantly lower than that of the first shale oil. Preferably, the first shale oil will be present in an amount from 90 to 10 weight percent of the mixture and the second shale oil will be present in an amount from 10 to 90 weight percent of the mixture.

In accordance with another embodiment of the present invention, there is provided a method for lowering the pour point of a first shale oil having a pour point above 20° F. (−7° C.) which comprises forming a mixture of the first shale oil and a second, whole, shale oil having a pour point below 20° F. (−7° C.), said second shale oil being present in said mixture in an amount sufficient to provide the mixture with a pour point significantly lower than that of the first shale oil. Preferably, the first shale oil will be present in an amount from 90 to 10 weight percent of the mixture and the second shale oil will be present in an amount from 10 to 90 weight percent of the mixture.

DETAILED DESCRIPTION OF THE INVENTION

Figure 1:
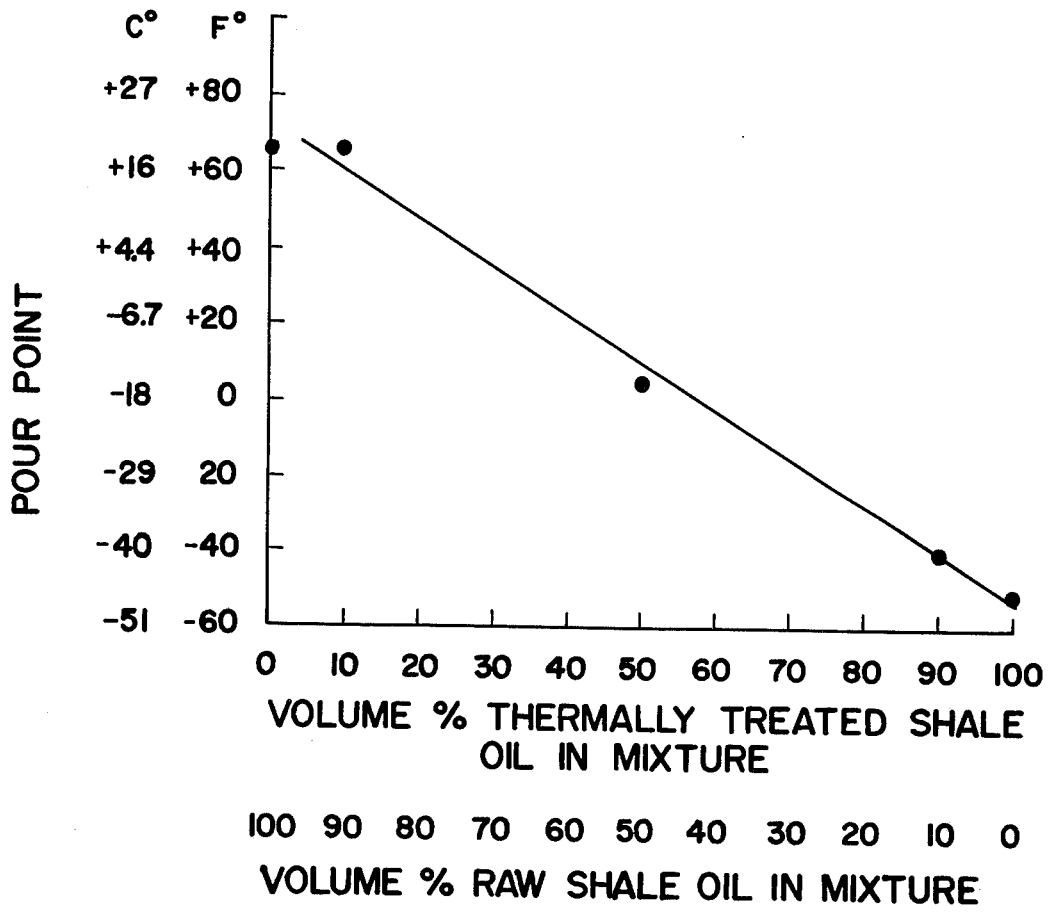
FIG. 1 is a graph of an embodiment of the present invention showing that the pour point of a mixture having various proportions of raw shale oil and thermally treated shale oil.

The following terms used in the specification and claims are defined as indicated:

"Raw shale oil" is a shale oil or fraction thereof recovered from a retorting process, which oil has not subsequently been heated to 600° F. (316° C.) or more.

"Whole shale oil" is a shale oil recovered from a retorting process from which less than 10 volume percent of the oil has been subsequently removed by a non-homogeneous separation method such as distillation.

"Thermal treating" is maintaining an oil within a specified temperature range for a specified duration, sufficient for formation of a pour point depressant, yet not so severe that significant thermal cracking or visbreaking of the oil occurs.

"A temperature below the point of significant thermal decomposition" of the shale oil means that substantially no cracking or visbreaking of the oil will occur and substantially no (less than 1 or 2 percent by weight of the oil) methane, ethane or elemental carbon will be produced during the thermal treating step.

"Significantly lower pour point" means a pour point of at least 10° F. (5.6° C.), preferably 20° F. (11° C.), and still more preferably 30° F. (17° C.), lower than that of the reference oil.

One of the components of the present composition is a first shale oil having a pour point above 20° F. (−7° C.). This invention is particularly useful when the first shale oil has a pour point above 40° F. (4.4° C.) and especially useful when the pour point is above 50° F. (10° C.). This first shale oil may be any shale oil or fraction thereof which meets the pour point requirements, for example, full-boiling-range shale oil, shale oil fractions, shale oil residuals and any combination of them. The first shale oil may be produced by any conventional retorting process, either in situ or aboveground. Conventional retorting process are carried out by destructive distillation of naturally occurring oil shale at temperatures which usually range upwards of 900° F. (482° C.). The heat necessary for the retorting may be supplied to the shale by direct combustion within the retort or by indirect heating means such as contact with hot gases or solids.

The composition of the present invention also contains an amount of a second shale oil having a pour point below 20° F. (−7° C.). This amount of the second shale oil should be sufficient to provide the composition with a pour point significantly lower than that of the first shale oil. The second shale oil should be a whole shale oil, i.e., a full-boiling-range shale oil from which less than 10 volume percent has been removed by nonhomogeneous separation methods such as distillation. Although any low-pour-point shale oil may be employed, the second shale oil is advantageously made by thermally treating whole shale oil. A particularly useful method for producing a thermally treated whole shale oil is described in my copending application Ser. No. 891,567, filed Mar. 29, 1978, entitled "Method For Lowering The Pour Point Of A Shale Oil", relevant portions of which are incorporated herein by reference.

When a thermally treated whole shale oil is used as the second shale oil, the composition will preferably comprise in admixture, a first shale oil having a pour point above 20° F. (−7° C.) and a second, whole shale oil having a pour point below 20° F. (−7° C.) in an amount sufficient to provide the composition with a pour point significantly lower than that of said first shale oil, said second shale oil being made by the process comprising (a) thermally treating a raw whole shale oil feedstock having a pour point in excess of 20° F. (−7° C.) in a treating zone at conditions including a temperature from 600° F. (316° C.) to below the point of significant thermal decomposition of said feedstock, a pressure sufficient to maintain said feedstock substantially in liquid phase and a time from 0.02 to 5 hours; and (b) withdrawing from said zone a thermally treated shale oil having a pour point at least 40° F. (22° C.) lower than the pour point of the feedstock. Preferably, the thermally treated shale oil will have a viscosity at least 85% of that of said feedstock.

The present invention also provides a method for lowering the pour point of a first shale oil having a pour point above 20° F. (−7° C.). This method comprises forming a mixture of the first shale oil with a second, whole, shale oil having a pour point below 20° F. (−7° C.) in an amount sufficient to provide the mixture with a pour point significantly lower than that of the first shale oil. Preferably the mixture will have a pour point at least 20° F. (−7° C.) lower than that of the first shale oil. The importance of this method is that it provides a transportable shale oil composition without the necessity for thermally treating all of the shale oil. Only a portion of the shale oil from the retort need be thermally treated, and then it may be combined with raw shale oil to provide a product which can safely be handled at ambient temperatures without fear of it setting up.

EXAMPLE

The following specific example will serve to further illustrate the method and composition of the present invention and the advantages of them. The example is not intended to limit the present invention.

EXAMPLE 1

A study was done on the relationship between the pour point of a mixture of raw shale oil and a low-pour-point shale oil versus the proportions of the oils in the mixture. The raw shale oil had a pour point of +65° F. (16° C.) The low-pour-point oil was a thermally treated whole shale oil having a pour point of −50° F. (−45° C.). The results are shown in FIG. 1. The data show that the pour point of the mixture is lowered by the addition of the low-pour-point shale oil and that the pour point decreases approximately linearly with the amount of low-pour-point shale oil in the mixture. Thus, a person having to transport a +65° F. (+16° C.) raw shale oil, but wanting to lower the pour point to +10° (−12° C.) to avoid danger of it setting up, need only thermally treat half the shale oil to a −50° F. (−45° C.) pour point and combine it with the untreated portion. The resulting composition will have the desired pour point. Using the linear relationship as shown in FIG. 1, a shale oil composition may be formulated to a desired pour point by simply adjusting the proportions of the first shale oil and the second shale oil.

What is claimed is:

1. An improved low-pour-point shale oil composition comprising in admixture, a first shale oil having a pour point above 20° F. (−7° C.) and a second, whole, shale oil having a pour point below 20° F. (−7° C.), said second shale oil being produced by thermally treating a raw whole shale oil feedstock having a pour point in excess of 20° F. (−7° C.) in a treating zone at conditions including a temperature from 600° F. (316° C.) to below the point of significant thermal decomposition of said feedstock, a pressure sufficient to maintain said feedstock substantially in liquid phase and a time from 0.02 to 5 hours, said second shale oil being present in said composition in an amount sufficient to provide said composition with a pour point significantly lower than that of said first shale oil.

2. The composition of claim 1 wherein pour point thereof is at least 20° F. (11° C.) lower than that of said first shale oil.

3. The composition of claim 1 wherein said amount of the second shale oil is from 10 to 90 weight percent of the composition, and the first shale oil is present in an amount from 90 to 10 weight percent of the composition.

4. A method for lowering the pour point of a first shale oil having a pour point above 20° F. (−70° C.), which comprises forming a mixture of said first shale oil and a second, whole, shale oil having a pour point below 20° F. (−7° C.), said second shale oil being produced by thermally treating a raw whole shale oil feedstock having a pour point in excess of 20° F. (−7° C.) in a treating zone at conditions including a temperature from 600° F. (316° C.) to below the point of significant thermal decomposition of said feedstock, a pressure sufficient to maintain said feedstock substantially in liquid phase and a time from 0.02 to 5 hours, said second shale oil being present in said mixture in an amount sufficient to provide the mixture with a pour point significantly lower than that of said first shale oil.

5. The method of claim 4 wherein said mixture has a pour point at least 20° F. (11° C.) lower than that of the first shale oil.

6. The method of claim 4 wherein said amount of the second shale oil is from 10 to 90 weight percent of the mixture, and said first shale oil is present in an amount from 90 to 10 weight percent of the mixture.

* * * * *